US005693267A

United States Patent [19]

Beshore et al.

[11] Patent Number: 5,693,267

[45] Date of Patent: Dec. 2, 1997

[54] FAST RESPONSE IODINE VAPORIZATION WITH AN INTEGRATED ATOMIZER AND MIXER

[75] Inventors: David G. Beshore, Newbury Park; Alan Z. Ullman, Northridge, both of Calif.

[73] Assignee: Boeing North American, Inc., Seal Beach, Calif.

[21] Appl. No.: 722,533

[22] Filed: Sep. 27, 1996

[51] Int. Cl.[6] ..... B01F 3/04

[52] U.S. Cl. ..... 261/142; 261/16; 261/50.3; 261/35; 392/399

[58] Field of Search ..... 261/142, 116, 261/16, 50.3, 35; 392/390, 397, 398, 399, 400

[56] References Cited

U.S. PATENT DOCUMENTS

| | | | |
|---|---|---|---|
| 2,437,963 | 9/1948 | Langmuir et al. | 392/400 |
| 3,243,575 | 3/1966 | Vignere | 392/399 |
| 3,776,462 | 12/1973 | Payne, Jr. | 392/397 |
| 4,036,915 | 7/1977 | Lucero et al. | 261/142 |
| 4,090,485 | 5/1978 | La Creta | 261/16 |
| 4,114,022 | 9/1978 | Braulke | 261/142 |
| 4,396,372 | 8/1983 | Matumoto et al. | 261/142 |
| 5,037,585 | 8/1991 | Alix et al. | 261/142 |
| 5,096,615 | 3/1992 | Prescott et al. | 261/142 |
| 5,372,754 | 12/1994 | Oho | 261/142 |
| 5,529,634 | 6/1996 | Miyata et al. | 261/142 |

*Primary Examiner*—Tim R. Miles
*Attorney, Agent, or Firm*—Steven E. Kahm; Harry B. Field

[57] ABSTRACT

This invention provides a means of achieving the close control of iodine flow rate, temperature of the resulting combined gaseous mixture of iodine in diluent gas, as well as the rapid start and stop response time needed for full-scale laser operation. It comprises an iodine charge stored as a solid and is heated to converted the iodine to a liquid, a means to heat the iodine under pressure to extend the liquid temperature range of iodine, an atomizer for complete vaporization of the iodine, a helium iodine mixer to provide heat for iodine vaporization purporting iodine to helium proportion mass ratio and provides for complete mixing and a flow control system which controls the low iodine flow rates accurately.

12 Claims, 2 Drawing Sheets

8
24
V
11
66
9
61
6
34
V
5
100
22
42
25
7
3
23
V
4
50
40
15
16
14
31
31
30
2
26
60

FIG. 4
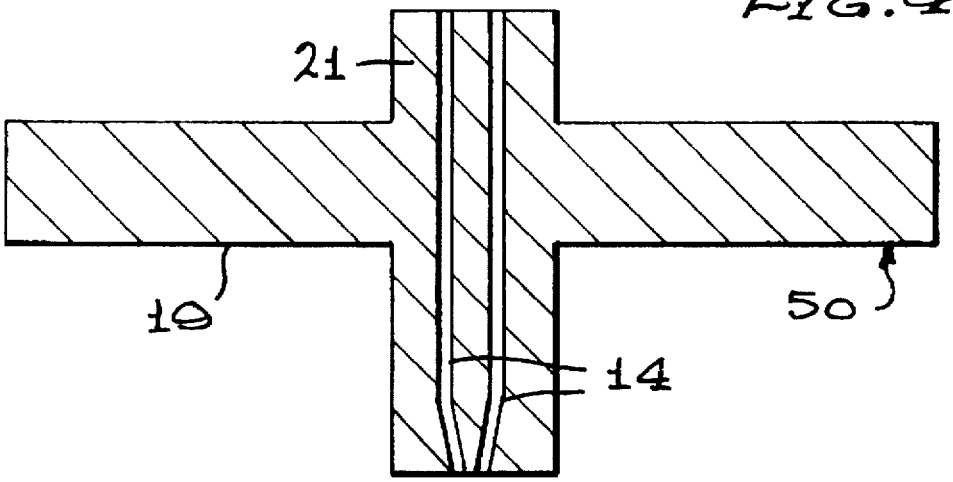
FIG. 3
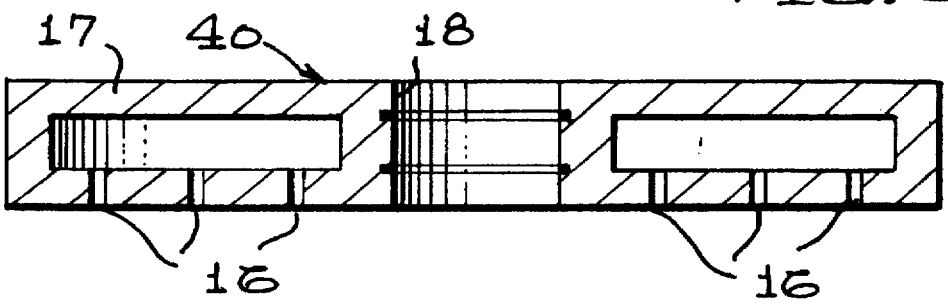
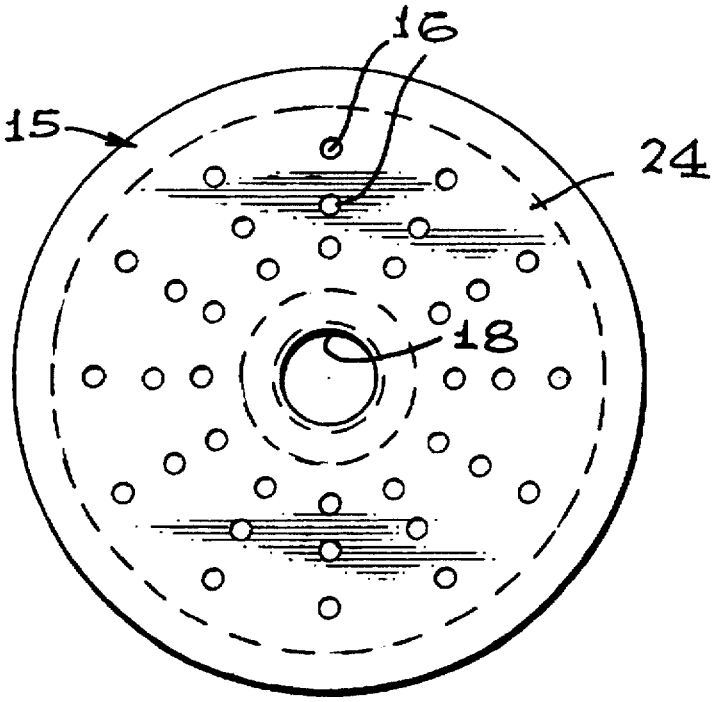
FIG. 2

FAST RESPONSE IODINE VAPORIZATION WITH AN INTEGRATED ATOMIZER AND MIXER

BACKGROUND OF THE INVENTION

1. Field of the Invention

This invention relates to the production of diluted iodine vapor streams and more particularly to a device that vaporizes iodine in a compact volume by intimate mixing with diluent gases.

2. Description of Related Art

Current technology entails vaporizing or subliming iodine in a hot vessel containing the iodine with electric heaters or heat lamps on the vessel and saturating a gas flow passing through that vessel. Historically, this heating and gas handling has presented problems in controlling the heat to the iodine which relates to the control of the rate of evolution of iodine into inert gas. Further, when the iodine is vaporized in a heated vessel, problems are encountered in containing and transporting the highly corrosive liquid iodine. Lastly, current technology vaporizes iodine in vessels containing relatively large amounts of iodine, making it very difficult to obtain rapid changes in vaporization rate.

SUMMARY OF INVENTION

This device provides a means of achieving the control of iodine flow rates, and the temperature of gaseous mixture, as well as providing rapid start and stop response times needed for full-scale laser operation. This device provides a controlled means of providing iodine flow to an atomizer and mixing the vaporized iodine with a diluent, such as helium or nitrogen, in order to provide the correct ratios of iodine to diluent for use in a chemical iodine oxygen laser. Adjustments in the flow rate are obtained through a control valve, which can be used in a feedback control loop for precise control of flow to the iodine vaporizer. Nearly instantaneous start and stop conditions are also achieved with this control valve and feedback loop. After use, the assembly can be removed and quickly replaced by a new iodine charged subassembly. Previous methods had been slow to heat the iodine and control the flow rate due to the subliming properties of iodine. Rapid heating cannot be achieved in other methods, due to the low thermal conductivity of iodine which reduces the heat transfer to the liquid and results in reduced vaporization of iodine liquid.

The iodine vaporizer comprises: an iodine charge which is stored as a solid and which is heated to converted the iodine to a liquid; a means to heat the iodine under pressure to extend the liquid temperature range of iodine; an atomizer to facilitate complete vaporization of the iodine; a gas mixer to provide heat for iodine vaporization and which provides the desired ratio of iodine to diluent gas; and a flow control system which controls the iodine and diluent gas flow rates accurately.

OBJECTS OF THE INVENTION

It is an object of the invention to reduce the start and stop transients of gaseous iodine production to a laser.

It is a further object of the invention to provide an iodine flow rate in a consistent and accurate manner.

It is a further object of the invention to provide a controlled temperature to the diluted iodine gas mixture.

It also an object of the invention to reduce the volume of the equipment to vaporize the iodine.

It is another object of the invention to provide a means to control the flow rate of iodine through a feedback control loop positioning device to a control valve.

It is yet another object of the invention to mix the vaporized iodine and hot helium in the proper weight or mass ratios and the proper temperature for the correct mixture to chemical oxygen lasers.

It is also an object of the invention to provide an easy and reliable method to replace the charge of solid or liquid iodine in an easy and safe manner.

It is still a further object of the invention to melt solid iodine to a liquid form and maintain the iodine in a liquid form prior to atomization and mixing with the helium.

Other objects, advantages and novel features of the present invention will become apparent from the following detailed description of the invention when considered in conjunction with the accompanying drawings.

BRIEF DESCRIPTION OF THE DRAWINGS

FIG. 2 is a front-view of the helium injection orifice plate and single element iodine injector.

FIG. 3 is a side view showing a sub-assembly of the helium injector.

FIG. 4 is a side view showing a sub-assembly of the iodine injector plate.

DETAILED DESCRIPTION OF THE PREFERRED EMBODIMENT

Figure 1:
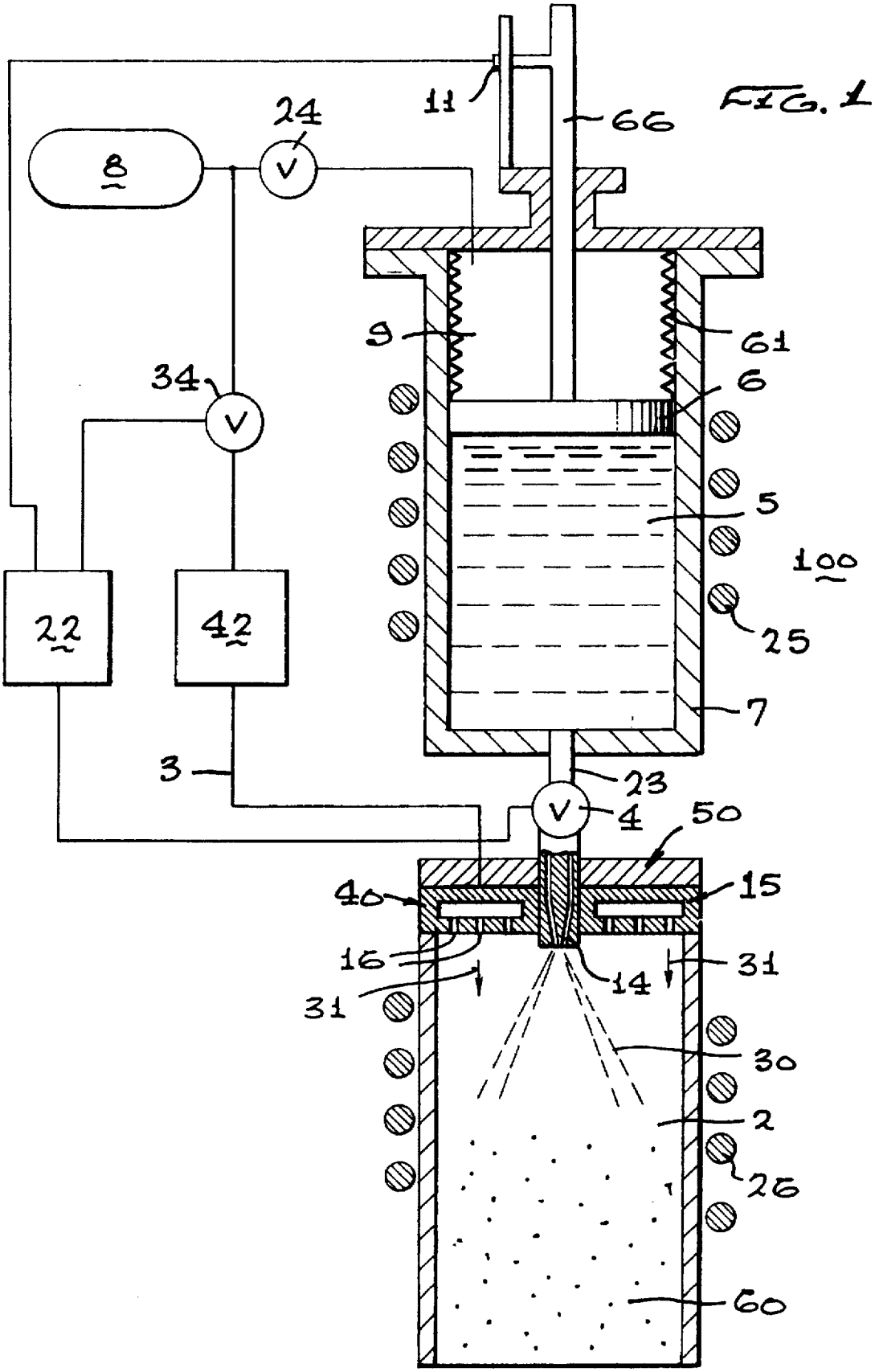
FIG. 1 is a schematic of the iodine generator consisting of iodine charge valve mixing chamber and control vice.

In FIG. 1 the iodine generator 100 is made up of a charge of solid iodine 5 contained in vessel 7 which is heated by electric heater 25 and allowed to melt and expand within vessel 7. The iodine has to be kept in a sealed vessel such as vessel 7 for safety since iodine is toxic. The iodine containing vessel 7 is connected to a pneumatic source 8, which pressurizes the iodine charge in vessel 7 either directly or through a piston 6 having bellows 61. Actual flows, rates and levels of iodine maybe determined by several means, including the use of a linear voltage differential transmitter (LVDT) 11, sensing the movement of piston rod 66 which is connected to piston 6. This may be used to detect a volume difference between the solid and liquid states of the iodine for initial melting. Upon fully melting, a control valve 4 may be opened on demand admitting iodine to a singlet, doublet, or triplet injection element 14 and atomized to an average droplet size of 100 to 200 microns. The volume 9 behind piston 6 is pressurized with a gas such as helium, nitrogen, or argon from inlet 8 to feed the iodine 5 to the injection element 14 which sprays iodine into the gas/iodine mixing chamber 2. Hot helium 31 produced in gas heater 42 flows through line 3 and is mixed with the atomized iodine in helium/iodine chamber 2, by co-flowing the helium through multihole orifice plate 15 surrounding the single element iodine injector 14 having face plate portion 24 (as seen in FIG. 2). The relative loss between the hot helium 31 and iodine droplets 30 enhances the heat transfer to the iodine droplets 30 by forced convection. The mixing chamber 2 is surrounded by heater 26 and is sized to provide complete vaporization of the helium-iodine droplets 60 prior to injection into the laser nozzle. The length of the helium-iodine mixing chamber 2 is dependent upon the temperature of the injected iodine droplets 30 at the injection element 14, the temperature of the helium 3 injected into the helium-iodine mixing chamber 2, and the size of the atomized liquid droplets of helium 31 and iodine 30.

Around the iodine generator 100, including the iodine charge 5, control valve 4, the iodine injector assembly 40, the helium injector assembly 50, and the helium-iodine mixing chamber 2, is an electrical heater 25 which maintains iodine generator 100 at the required temperatures, on the order of 200–500 degrees Fahrenheit. This ensures that all of the iodine in the system is in a liquid state or gaseous state. If solids were to form in any of the assemblies, as mentioned above, then solid formation would lead to plugging the control valve 4, the iodine injector assembly 40, the helium injector assembly 50, or plating out of solid iodine in the helium-iodine mixing chamber 2.

High accuracy's of iodine flow rate are achieved by monitoring the linear voltage differential transmitter (LVDT) 11 voltage rate change with accuracy's on the order of ±1%. Necessary adjustments in the flow rate of iodine into the helium-iodine mixing chamber 2 are indicated by the LVDT 11 are computed in the control system 22 and used to adjust the control valve 4 for iodine. Instantaneous start and stop conditions are also achieved with the control valve 4. The control system 22 also adjusts the hot helium flow 31 through line 3 by controlling valve 34. After use, the iodine charge sub-assembly 7 is removed and replaced by a new iodine charge subassembly 7.

Alternately, a gas other than helium may be used for pressurization of volume 9 and for mixing with iodine as flow 31. Appropriate gases include nitrogen and argon. Further, different gases may be selected for these two functions at appropriate to the particular application.

FIG. 2 shows one embodiment of helium and iodine injector hole patterns on the face of multihole orifice plate 15 of helium injector assembly 40, and the face 24 of the injector 14 on iodine injector assembly 50. The iodine injector assembly 50 consists of a singlet, doublet or triplet injection element 14 (here shown as a doublet) for providing an impending stream which provides the primary atomization of the liquid iodine, a spray of iodine droplets 30 is generated and co-flows with the hot helium 31 from concentric rings of orifices 16 in orifice plate 15. The injector consists of two parts, consisting of an iodine injector sub assembly 40 and a helium injector sub assembly 50 shown in FIGS. 3 and 4.

FIG. 3 shows a side view of the helium injector assembly 40, consisting of injector orifices 16 for injecting helium droplets into the helium-iodine mixing chamber 2, helium manifold 17 for feeding helium to the injector orifices 16, and a center hole 18 for inserting the iodine single element injector 14.

FIG. 4 shows a side-view of the iodine injector assembly 50 made up of an attachment plate 19, a injector element 14 for atomizing the iodine, and feed tube 21 which receives iodine through iodine pipe 23 from the charge of iodine 5. The flow of iodine is controlled by control valve 4.

Iodine injector assembly 50 is attached to the helium injector assembly 40 shown in FIG. 3 through the center hole 18 in the helium injector assembly 40. Chemical oxygen iodine lasers require gaseous iodine in a gaseous carrier stream (diluent helium, for example) during short duration bursts on the order of 1 to 100 seconds. Other requirements also dictate the supply of iodine in the diluent gas start and stop rapidly in less than one second, and be extremely uniform in flow rate and temperature on the order of less than 1%.

A control system 22 is used to sense the displacement of the iodine volume in vessel 7 by the movement of piston rod 66 which is connected to piston to the linear voltage differential transmitter (LVDT) 11 as an input to the control system 22, which in turn activates the control valve 4. As the flow rate of these devices is very low, high sensitivities of volume displacement are detected through the LVDT 11 in order to effect high accuracy's of flow rate control.

The solid iodine is melted to a liquid form and maintained in a liquid form prior to atomization. As the freezing point and boiling point of iodine are nearly equal, it is important to maintain a narrow temperature range under pressure, in order to enhance the flow control and atomization of iodine. Further, upon atomization, it is critical that the temperature of the atomized iodine liquid is maintained above the melting or boiling points of the iodine to quickly vaporize in a short chamber. Otherwise, the atomized liquid iodine will again turn solid and not provide sufficient quantities of gaseous iodine to iodine nozzles and chemical oxygen iodine lasers. Also, it is critical that all of the liquid is atomized and does not form particulate solid so that plugging of the iodine injectors element 14 does not take place.

The ratio of helium to iodine is selected to provide the required iodine and total gas flow required for operation of the associated iodine laser. In turn, the required helium temperature in flow 3 is determined by the required mass flows, the temperature needed to maintain the iodine in the gaseous form, and the need to provide the heat of vaporization of the iodine. The helium flow is controlled by the pressure applied to orifice plate 15.

Flows of iodine and helium are started and stopped rapidly using valves 4, 24 and 34 which are arranged so as to rapidly change the flow rates of helium, hot helium and iodine. The extremely small hold-up volumes downstream of valve 4 produces a system which can rapidly pressurize and depressurize the supply manifold to the iodine laser.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. An iodine vaporizer comprising:

a mixing chamber for mixing atomized iodine and helium to form helium-iodine droplets, a vessel for storing an iodine charge as a solid, a means to heat the solid iodine charge under pressure in the vessel to converted the solid iodine to a liquid and extend the liquid temperature range of the liquid iodine, an iodine atomizer in the mixing chamber fluidly connected to the vessel to feed atomized iodine droplets to the mixing chamber, a helium manifold for injecting helium into the mixing chamber, a means for heating the mixing chamber to promote the mixing of helium with atomized iodine and to keep the iodine vaporized, a means for controlling the flow of iodine to the iodine atomizer, such that a supply of helium-iodine droplets having a mass ratio of between 0.5 and 2 to 1 is produced.

2. An iodine vaporizer as in claim 1 wherein:

the iodine atomizer reduces the iodine droplet size by impinging streams.

3. An iodine vaporizer as in claim 2 wherein the impinging streams are from a doublet injection element to reduce the iodine droplet size.

4. An iodine vaporizer as in claim 2 wherein the impinging streams are from a triplet injection element to reduce the iodine droplet size.

5. An iodine vaporizer as in claim 1 wherein:

the mixing chamber heats helium and a uniformly mixing injector plate assembly.

6. An iodine vaporizer as in claim 1 wherein:

the means for controlling the flow of iodine to the iodine atomizer comprises a piston in the chamber which moves as the volume of the iodine in the chamber changes, a rod attached to the piston, a linear voltage differential transmitter attached to the rod senses the changes in volume inside the vessel by the linear motion of the rod, data from the linear voltage differential transmitter is sent to a control system which processes the data and controls a valve regulating iodine flow to the iodine atomizer.

7. An iodine vaporizer as in claim 1 wherein:

the means of heating the mixing chamber is an electric heater surrounding the mixing chamber.

8. An iodine vaporizer as in claim 1 wherein:

the means of heating the solid iodine charge is an electric heater surrounding the vessel.

9. An iodine vaporizer as in claim 1 wherein:

the iodine atomizer is centered in the helium injection manifold, the helium injection manifold producing streams of helium injected into the mixing chamber, such that the iodine droplets are injected parallel to the injection stream of the helium.

10. An iodine vaporizer as in claim 1 wherein:

the means for controlling the flow of iodine to the iodine atomizer produces a supply of helium-iodine droplets having a mass ratio of between 0.5 and 2 to 1.

11. An iodine vaporizer as in claim 1 wherein:

the gas supplied is nitrogen rather than helium.

12. An iodine vaporizer as in claim 1 wherein:

the gas supplied is argon rather helium.

* * * * *